United States Patent [19]

Langer et al.

[11] 4,329,308

[45] May 11, 1982

[54] METHOD OF MAKING AN ABRADABLE STATOR JOINT FOR AN AXIAL TURBOMACHINE

[75] Inventors: Herbert Langer, Dammarie les Lys; Gérald Saiveau, St. Germain les Corbeil, both of France

[73] Assignee: Societe Nationale d'Etude et de Construction de Moteurs d'Aviation, Paris, France

[21] Appl. No.: 62,988

[22] Filed: Aug. 2, 1979

Related U.S. Application Data

[62] Division of Ser. No. 762,344, Jan. 25, 1977, abandoned.

[30] Foreign Application Priority Data

Jan. 30, 1976 [FR] France ..... 76 03140

[51] Int. Cl.[3] ..... B29C 17/00

[52] U.S. Cl. ..... 264/162; 264/293; 425/385

[58] Field of Search ..... 264/284, 293, 162, 269, 264/236; 425/385, 115

[56] References Cited

U.S. PATENT DOCUMENTS

| | | | |
|---|---|---|---|
| 2,410,744 | 11/1946 | Powers | 264/284 |
| 2,907,365 | 10/1959 | MacDonald | 264/293 |
| 3,051,608 | 8/1962 | Gordon | 264/284 |
| 3,141,913 | 7/1964 | Edwards | 264/284 |
| 3,541,216 | 11/1970 | Rocklis | 264/293 |
| 3,839,514 | 10/1974 | Nauta | 264/284 |
| 3,917,772 | 11/1975 | Hollenbeck | 264/284 |
| 4,105,816 | 8/1978 | Hori | 264/293 |

*Primary Examiner*—James B. Love
*Attorney, Agent, or Firm*—Bacon & Thomas

[57] ABSTRACT

The method of forming an abradable stator joint for a stage of an axial turbo machine having a cylindrical ring, the internal wall of which is closely adjacent to the tips of the blades of the stage. Honeycomb stampings are made in a strip of material set into the said wall preferably by means of serrated wheel action.

2 Claims, 10 Drawing Figures

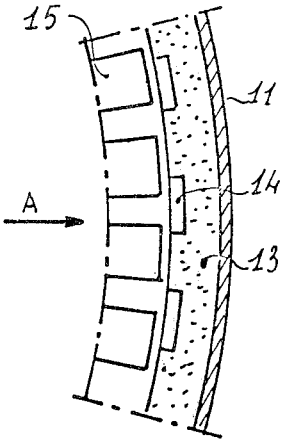
FIG. 1
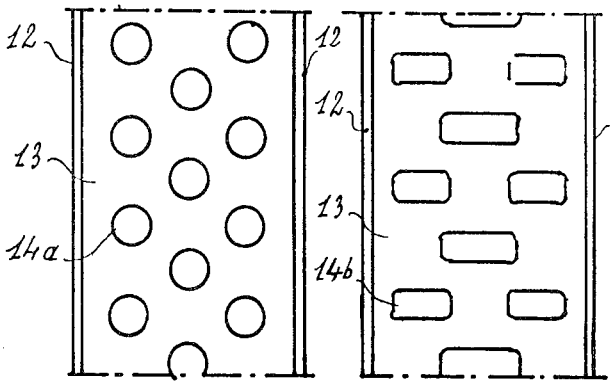
FIG. 2
FIG. 3
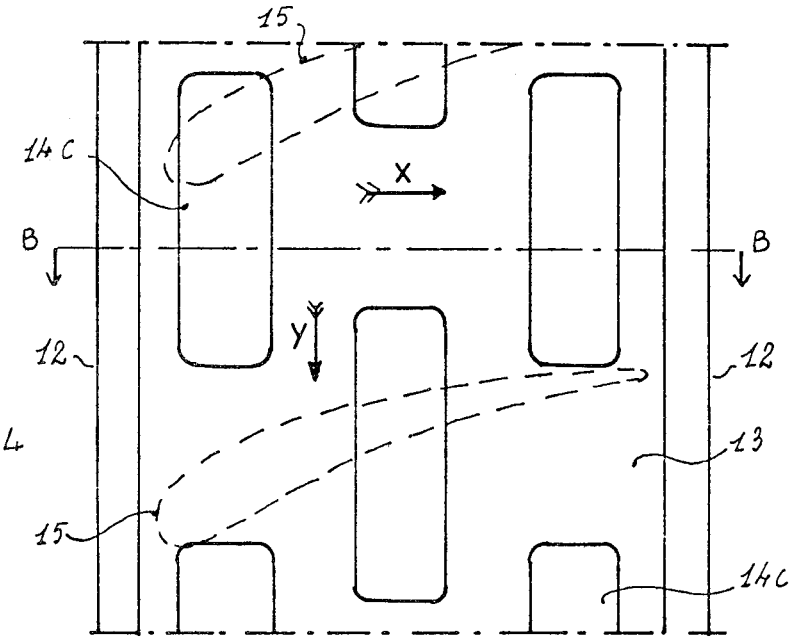
FIG. 4
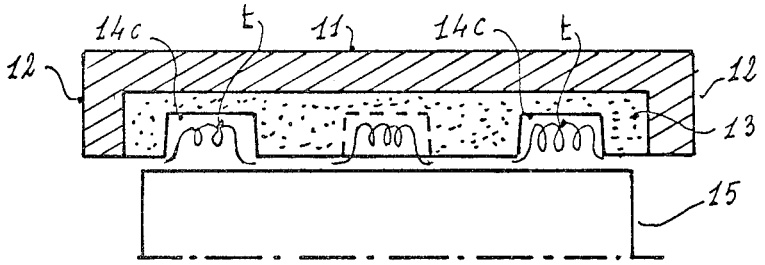
FIG. 5

METHOD OF MAKING AN ABRADABLE STATOR JOINT FOR AN AXIAL TURBOMACHINE

This is a division, of application Ser. No. 762,344, filed Jan. 25, 1977 now abandoned.

BACKGROUND OF THE INVENTION

It is known that abradable sealing joints may be made of compound metallic material (colmated ho neycomb, felt, etc.) or of polymeric resin preferably charged. When the temperatures of utilization allows it, it is advantageous to use the latter kind of material that offers not only the advantage of being easy to repair but also that does not require, for its setting, heating to a high temperature that is likely to warp the support of the joint which is generally a metallic collar bound to the stator or which constitutes an element of the stator itself.

An abradable joint cannot achieve an absolute air tightness. The unavoidable tolerances of tooling and assembling that cause ovalizations and offsettings, as well as the differences in dilatations that happen when the thermic conditions are not stationary, at the time of variation of the rotation speed for example, result in the fact that there remains a more or less pronounced gap between the internal wall of the joint and the tips of the blades. It has been found that by setting during the tooling, by means of turning, for example, circular grooves into the said internal surface of the joint, the flow of leak is substantially reduced. Indeed, these grooves cause eddies generating additional losses of charge that occur in addition to those due to the throttling. But, this tooling and the preliminary setting will keep a large size machine busy for a relatively long period of time.

SUMMARY OF THE INVENTION

The invention pertains to an abradable sealing ring joint of the kind intended for reducing, in a stage of axial turbomachine, the flow of leak between the tips of the blades of the rotor fan and the internal cylindrical wall of the stator. The abradable portion of the sealing joint according to the invention is made of a compound material with a polymeric resin base. The invention pertains also the method for constructing the said joint.

The subject of the invention is an abradable joint with polymeric resin base having the advantages of the working of grooved joints while being at the same time more sturdy and easier to make, hence more economical, and which, in addition, permits an increase in the reserve in the pumping in the case of a compressor.

The invention also concerns the method of constructing the said joint as well as the tools for carrying into effect the said method.

The abradable cylindrical joint of the invention, made up of a compound material with a polymeric resin base, is characterized by the fact that its internal cylindrical wall, that is to say, the one that is intended to cooperate with the tips of the blades of the rotor to achieve the wanted air tightness, bears honeycomb stampings, in other words, hollow stampings each one separated from the others by parts of the said internal wall. Therefore, the wall does not show any interruption of continuity. The stampings are conveniently grouped in several circular rows, in other words, the section of the wall separating two consecutive rows includes a continuous cylindrical surface.

In the method according to the invention, the said stampings are produced by pressure by means of a serrated wheel, for example, conveniently made of a series of toothed discs separated by smooth discs the diameter of which is, at the most, equal to the diameter of the toothed discs minus the teeth.

BRIEF DESCRIPTION OF THE DRAWINGS

Other uses and advantages of the invention will appear in the description that follows of examples of realization of the abradable joint of the invention and of the carrying into effect of the method in reference to the attached drawings in which:

FIG. 1 is a diametrical diagrammatic section of a stage of a turbomachine, the stator of which comprises an abradable joint according to the invention;

FIGS. 2 and 3 are partial views, in the A direction of FIG. 1, of two variants of the joint of the invention;

FIG. 4 is a partial view, in the A direction of FIG. 1, of a preferential variant of the joint according to the invention, shown on a larger scale than the variants on FIGS. 2 and 3;

FIG. 5 is a partial section of the joint shown on FIG. 4, taken from the axial plane BB of FIG. 4;

DESCRIPTION OF THE PREFERRED EMBODIMENTS

Figure 6:
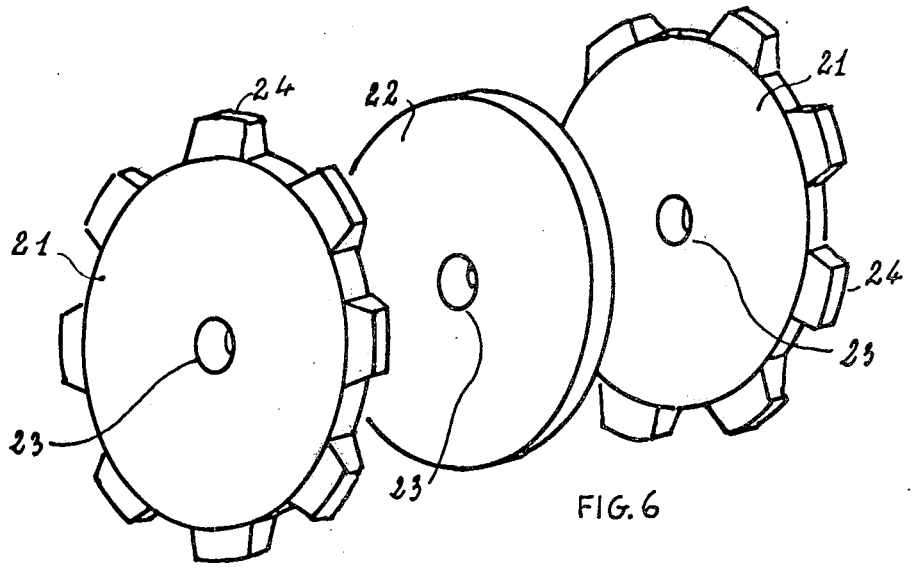
FIG. 6 shows, in perspective, elements of a serrated wheel according to the invention.

The figures are limited to the representation of only those elements necessary for the understanding of the various uses of the invention.

First, consider simultaneously FIGS. 1, 2 and 3. The cylindrical collar 11, made of metal (steel, titanium, or light alloy), tooled to form a track bordered by rims 12 in the shape of a crown, is the supporting element for the joint. This track may also be smooth, the rims 12 may be temporarily added during the making of the joint, then dismantled. It may be inserted into the housing of the stator, not shown, of the axial turbomachine under consideration, or it may constitute an element of the housing itself. The elements for linking with, or fixing to the other parts of the stator are not shown. The joint 13 is a ring of charged polymeric resin. It is closely bound to the support 11–12 in which it has been formed by molding. According to the invention, honeycomb stampings 14, or 14*a*, or 14*b* have been provided in it. The blades 15 of the corresponding rotor stage are indicated in FIGS. 4 and 5 by broken line. The distance separating the surface of their tips from the wall of the joint has been substantially exaggerated. In this application reference to "honeycomb" stampings is intended to refer to and include discrete depressions of other shapes than hexagonal. Thus, in accordance with the description, round or rectangular depressions or recesses arranged and distributed over the surfaces are intended to be included within the term "honeycomb".

The material of the joint may be made up, by weight, of, for example, 40% of an epoxy resin (including the hardener and the accelerator) and of 60% of talcum, or of 98% of resin and 2% of glass microballs. The exact composition of the resin is not given here, there are many kinds the selection of which depends on the conditions of utilization, some polymerize when cold and others when hot. In fact, in some cases, other hardening resins such as polyimid or phenolic resins may be used. Also organic charges (phenolic microballs, for example) may be used instead of the above-mentioned mineral charges. Non-inflammable material may also be used as the material of the joint. An important condition in the selection of the components of the resin is that it may remain, after setting, in a stable pasty state allowing the making of impressions that will be described later. This operation facilitates the honeycomb stamping such as 14, 14*a*, or 14*b* of FIGS. 1, 2 and 3. We shall examine later the conditions governing the geometry of these stampings.

Now, consider FIGS. 4 and 5 where we find again the collar support 11, its rims 12, the joint 13, the stampings 14 (14*c* here) and the blades 15. The broken line shows the outlines of the blades in FIG. 4. The arrow X indicates the direction of the movement of the fluid and the arrow Y the direction of rotation of the blades.

As has already been mentioned, the narrow gap subsisting between the tips of the blades 15 and the internal wall of the joint 13 constitutes, to the right of each tip of blade, when the stampings are not there, a throttling channel through which the fluid circulates to form eddy currents in a direction tending to nullify the effect of the suppressions due to the movement of the blades. If the stampings are correctly distributed, each one of those located to the right of each blade tip at a specified time constitutes an extension of the section of the said channel in which the eddies t diagrammed on FIG. 5 take place. Thus, the effect of the stamping is due to the fact that the loss of charge affecting the eddy currents are higher when they result from both the throttling phenomenon and the eddy phenomenon than when they result only from the throttling phenomena.

In order to make the examination of FIGS. 2, 3, 4, and 5 easier, the stampings have been grouped in only three circular rows. In most cases, it is preferred to adopt a substantially higher number of rows to multiply the sequences of throttling and eddy effects. The stampings may be given many various shapes. Those in FIG. 2 are circular. Those in FIG. 3 are oblong (rectangular) with their longer axis oriented in a direction parallel to the axis of the machine. Those in FIGS. 4 and 5 are oblong, rectangular, for example, with their longer axis oriented in a direction transverse of the axis of the machine. This latter configuration seems to be one of the most favorable since it allows for a maximum number of rows compatible with the longitudinal clearance of the joint while keeping between the rows a continuous cylindrical surface which facilitates the designing of the searrated wheel. Of course, these advantages are decisive only if the stampings are sufficiently elongated in shape, their longest dimension being, at least, equal to twice their shortest.

Further, it is preferred:

That the number of stampings per row and the number of rotor blades be prime between themselves to avoid the creation of resonances.

That the stampings be staggered from one row to the other, set up in quincunx for example, so that the tip of each blade, whatever its angular position may be, is in front of at least one stamping. In fact, this staggering renders the joint less susceptible to cracking because, then, the intervals between stampings form three branch knots lending themselves better to a correct repartition of the pressings than the four branch knots would be formed by the intervals between non-staggered stampings.

In order to optimize the performances of this kind of joint, the shape and the repartition of the stampings may be different depending on the stage under consideration, further, for the same stage, the shape of the stampings may be different, their depth in particular, according to the circular row under consideration. This may be easily accomplished thanks to the construction methods described below.

On FIG. 5, it may be seen that the sides of the stampings are tapered so that the stamping with the serrated wheel may be done without stripping.

Now, consider FIG. 6. It shows two toothed discs 21 for stamping separated by an intercalated smooth disc 22. The serrated wheel is obtained by stacking the appropriate number of discs 21 and 22, threaded through their bores 23 on a common axis that is part of the serrated wheel holder, of a known kind, not shown here. The diameter of the intercalate discs 22 is equal to the diameter of the toothed discs 21 minus teeth. The height of the teeth 24, which as we have seen are tapered, is substantially greater than the depth of the stampings to be made. Indeed, the stamping causes extra thickness and burs by extrusion and they must be eliminated by long-turning. It will be noted that the teeth of the two shown discs 21 have been staggered in assembling in order to obtain the staggering of the stampings from one row to the next.

Thus, the distribution of the stampings in distinct rows permits making the serrated wheels economically since they are built by stacking parts easy to make. The working parts of the serrated wheel, that is to say the teeth and the surfaces between the teeth, should be smooth and preferably covered with an antiadhesive coating, a suspension of halogenous polycarbide (Teflon or similar polymeric) for example.

With this kind of tools it is very easy to vary the shape of the stampings by making discs with teeth of different shapes. For example, a different serrated wheel may be made with discs with identical toothing for each stage, or if it is desired to vary the shape of the stampings from the leading edge to the tail edge of the blades of a given stage, one could stack, to make the serrated wheel, discs with different tooth shapes.

Figure 7:
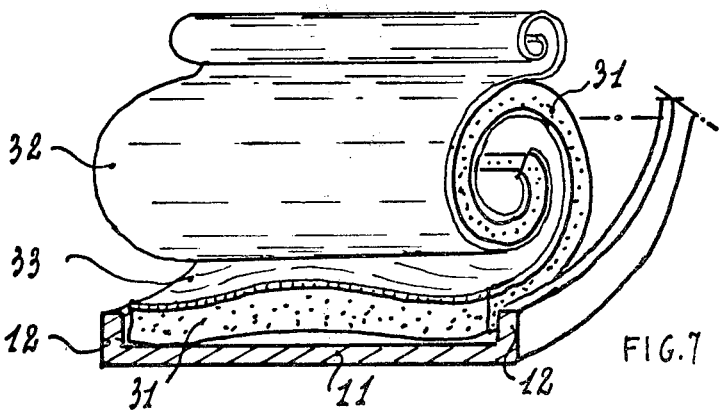
FIG. 7, which is a view in perspective, and FIGS. 8 and 9, which are axial sections of the joint according to the invention, are diagrams illustrating various steps of the carrying into effect of the method according to the invention.
Figure 8:
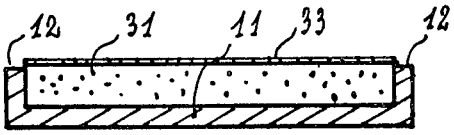
Figure 9:
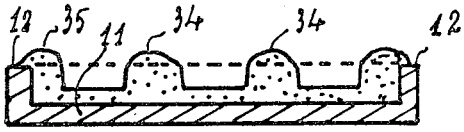

FIGS. 7, 8, and 9 show various steps of the carrying out of the method according to the invention.

The charged resin, mixed with its hardener is first rolled in a sausage which is spread to the shape of a ribbon 31 of an appropriate thickness and width and which is placed between two thin sheets 32 and 33 of an anti-adhesive material (PVC, polyethylene, etc.). To achieve a full homogeneity of the mixture the ribbon is kept cold (−5° C., for example) for 48 hours. Then, it is left in the ambient air in the same location as the collar to be fitted until their temperatures have become almost equal. The application is made on the track set up on the collar 11 between the rims 12 (FIG. 7). As the application is being made, the anti-adhesive band—in this case the band 32—protecting the face of application of the ribbon 31, is removed.

When the application is done, the ribbon of resin 31 is pressed down by means of a roller to achieve a close contact with the collar 11 (FIG. 8) so that the polymerization that follows cause an adhesion.

The band 33 is then removed and the stamping is performed.

In case a material other than the one chosen in this example is being used, the application of the compound material with a polymeric resin basis could be realized by other means. The compound material could be applied on the track of the collar by means of a spatula.

The stamping is then done, the serrated wheel holder being held in one hand or by a device not shown here. The serrated wheel stamping will, of course, leave extra thickness 34 or burs 35 (FIG. 9).

Figure 10:
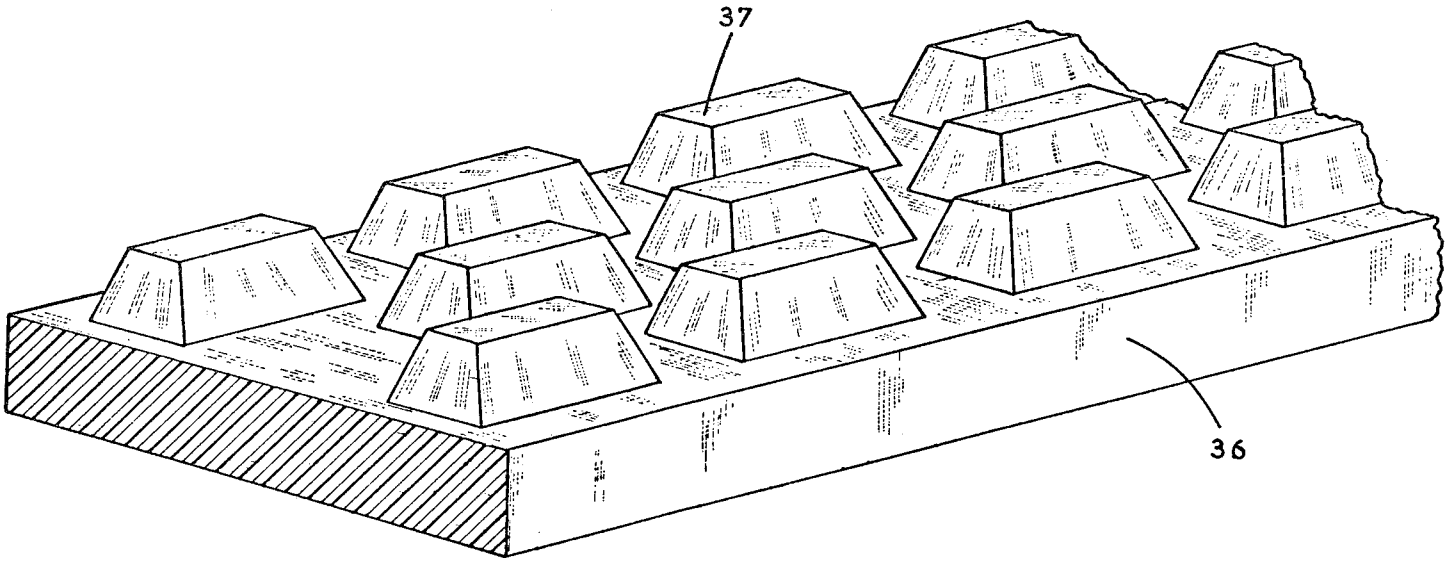
FIG. 10 is a partial representation, in perspective, of a variant of the tools.

In a variant shown on FIG. 10, the serrated wheel could be replaced by a strip 36 made of flexible material conveniently selected and obtained by means of molding, for example. This strip is provided with knobs 37 with tapered sides corresponding to the stamping to be made. This strip is applied on the ribbon of resin 31 exerting sufficient pressure by appropriate means (webbing, inflatable bodies, etc.) so that the knobs penetrate into the resin. Then the strip is removed.

It is understood that, for each stage, a strip with knobs of specific shapes and distribution may be provided. In the same manner, for a given strip the shape of the knobs, their height especially, may vary from one row to the other.

The joint obtained is then polymerized in the air or in a drying room according to the temperature required for the selected resin. Finally, the long-turning on the internal wall of the joint is performed to bring the joint to its final thickness (broken line on FIG. 9). This very simple operation is much faster than the full tooling that a joint with continuous grooves would require. It must also be noted that the joint with stampings according to the invention is much more sturdy than a continuous grooved joint. In the latter, the continuity of the line at the bottom of the grooves tends to favor the propagation of cracks.

We claim:

1. A method of making an abradable sealing stator joint for a stage of an axial turbomachine having a bladed rotor, said stator having a cylindrical collar defining a track bordered by two rims, said joint consisting of a cylindrical ribbon made of a material with a polymeric resin base in said track between said rims, said method including the steps of:

stamping recesses in the ribbon, while uncured, by means of a serrated wheel action thereby simultaneously compressing the ribbon into the track;

polymerizing the ribbon to cause the same to adhere to said track; and machining the internal wall of the polymerized joint in order to eliminate the extra thickness and burs left by the serrated wheel action.

2. A method of making an abradable sealing stator joint for a stage of an axial turbomachine having a bladed rotor, said stator having a cylindrical collar defining a track bordered by two rims, said joint consisting of a cylindrical ribbon made of a material with a polymeric resin base in said track between said rims, said method including the steps of:

stamping recesses in the ribbon, while uncured, by means of a flexible strip having protuberances thereon and thereby simultaneously compressing the ribbon into the track;

polymerizing the ribbon to cause the same to adhere to said track; and machining the internal wall of the polymerized joint in order to eliminate the extra thickness and burrs left by the stamping step.

* * * * *